US007794381B2

(12) United States Patent
Yamamoto et al.

(10) Patent No.: US 7,794,381 B2
(45) Date of Patent: Sep. 14, 2010

(54) Z-FOLDING APPARATUS AND SHEET PROCESSING APPARATUS

(75) Inventors: Mikio Yamamoto, Izunokuni (JP); Hiroyuki Taki, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 196 days.

(21) Appl. No.: 12/061,519

(22) Filed: Apr. 2, 2008

(65) Prior Publication Data

US 2009/0062097 A1 Mar. 5, 2009

Related U.S. Application Data

(60) Provisional application No. 60/968,857, filed on Aug. 29, 2007, provisional application No. 60/976,018, filed on Sep. 28, 2007, provisional application No. 60/980,728, filed on Oct. 17, 2007, provisional application No. 60/987,356, filed on Nov. 12, 2007.

(51) Int. Cl.
*B31F 7/00* (2006.01)

(52) U.S. Cl. ..... 493/421; 493/434; 493/442; 493/444

(58) Field of Classification Search ..... 493/420, 493/421, 434, 442, 444
See application file for complete search history.

(56) References Cited

U.S. PATENT DOCUMENTS 2,997,295 A * 8/1961 Beck ..... 493/23
4,917,366 A 4/1990 Muurakami et al.
4,985,013 A * 1/1991 van der Werff et al. ..... 493/444
5,037,364 A * 8/1991 Whittenberger ..... 493/14
6,881,181 B2 * 4/2005 Brown et al. ..... 493/419
7,326,166 B2 * 2/2008 Sytema ..... 493/421

FOREIGN PATENT DOCUMENTS

| | | |
|---|---|---|
| JP | 1990-282166 | 11/1990 |
| JP | 1993-760 | 1/1993 |
| JP | 1996-301511 | 11/1996 |
| JP | 2007-15785 | 3/1997 |
| JP | 2000-344418 | 12/2000 |
| JP | 2003-20163 | 1/2003 |
| JP | 2003-73005 | 3/2003 |
| JP | 2005-231778 | 9/2005 |
| JP | 2007-99507 | 4/2007 |

* cited by examiner

*Primary Examiner*—Hemant M Desai
(74) *Attorney, Agent, or Firm*—Patterson & Sheridan, LLP

(57) ABSTRACT

A Z-folding apparatus of an embodiment of the invention includes a pair of feed rollers to transport a sheet along a specified transport passage, a contact portion with which a head of the transported sheet comes in contact, a press member to press a specified position of the sheet apart from the head, and a pair of folding rollers to form a fold line on the sheet and to transport the sheet on which the fold line has been formed. When the head of the sheet comes in contact with the contact portion, the press member presses the specified position of the sheet apart from the head in a transport direction toward the pair of folding rollers, and guides it to a nip between the rollers of the pair of folding rollers.

13 Claims, 11 Drawing Sheets

Z-FOLDING APPARATUS AND SHEET PROCESSING APPARATUS

CROSS-REFERENCE TO RELATED APPLICATIONS

This application claims the benefit of U.S. Provisional Applications No. 60/968,857, filed Aug. 29, 2007; No. 60/976,018, filed Sep. 28, 2007; No. 60/980,728, filed Oct. 17, 2007; and No. 60/987,356, filed Nov. 12, 2007.

BACKGROUND OF THE INVENTION

1. Field of the Invention

The present invention relates to a sheet processing apparatus including a mechanism of folding a sheet-like medium such as, for example, a sheet.

2. Description of the Related Art

Hitherto, as a sheet folding mechanism to fold a sheet, for example, FIG. 1 of U.S. Pat. No. 4,917,366 shows a folding unit provided between a copying machine and a finisher unit, and FIG. 2 shows a folding device and sheet feed paths.

Further, as shown in FIG. 17, a Z-folding mechanism 100 is known in which roller pairs are arranged and a method of folding a sheet simultaneously with transport thereof is used. The Z-folding mechanism 100 includes a pair of feed rollers 101 and 102 to transport a sheet through a nip thereof at a constant speed in an arrow T0 direction (left direction in the drawing), a plate-like transport guide 103 to guide the sheet nipped and transported by the pair of feed rollers 101 and 102 in the horizontal direction, a stopper 104 with which the leading edge of the sheet collides at the end position of the transport guide 103 and which regulates the movement thereof, a feed roller 105 disposed rotatably in contact with the left side, in the drawing, of the one feed roller 101 in the vicinity of the start end of the transport guide 103, a feed roller 106 disposed rotatably in contact with the upper side, in the drawing, of the feed roller 105, a plate-like transport guide 107 to guide, in the vertical direction, the sheet fed upward in the drawing through a nip between the two feed rollers 101 and 105, and a stopper 108 with which the sheet collides at the end position of the transport guide 107 and which regulates the movement thereof. The four feed rollers 101, 102, 105 and 106 are always respectively rotated together at the same peripheral speed in the arrow directions in the drawing.

The Z-folding mechanism 100 operates as follows. First, the sheet is fed from the arrow T1 direction in the drawing to the nip between the feed rollers 101 and 102, and is transported along the transport guide 103 in the left direction in the drawing. After the leading edge of the sheet in the transport direction collides with the stopper 104, the sheet is further fed in the left direction in the drawing by the feed rollers 101 and 102, and a halfway portion of the sheet, which has nowhere to go, is warped and deformed by buckling.

Further, a convex side portion of the warped and deformed sheet escapes toward the nip between the feed rollers 101 and 105, is nipped and restrained by the feed rollers 101 and 105, and is transported upward in the drawing along the transport guide 107. At this time, the warped and deformed portion of the sheet passes through the nip between the feed rollers 101 and 105, so that the sheet is folded.

The leading edge, in the transport direction, of the sheet transported upward in the drawing along the transport guide 107 while the folded position is made the head, that is, the folded position collides with the stopper 108, and then, the sheet is further transported by the feed rollers 101 and 105, and the halfway portion of the sheet including, in this case, the leading edge of the sheet is warped and deformed by buckling.

The portion of the sheet, which is buckled and has nowhere to go, escapes toward the nip between the feed rollers 105 and 106 as shown in the drawing, is nipped and restrained by the feed rollers 105 and 106, and is fed toward the arrow T2 direction in the drawing. By the foregoing series of operations, the sheet is folded into Z-shape.

In the folding device as stated above, for miniaturization and simplification of the structure, the diameters of the rollers used for the feed rollers and the first and the second folding rollers are equal to one another, the feed directions of the feed rollers and the first folding rollers are made orthogonal to each other, and the feed direction of the first folding rollers and the feed direction of the second folding rollers are made orthogonal to each other, so that the miniaturization of the apparatus and the improvement of feed performance of the roller pairs are realized.

However, in the foregoing conventional Z-folding mechanism 100, since the leading edge of the sheet in the transport direction is collided with the stopper 104, 108 and the sheet is warped and deformed by buckling, there is a case where the sheet can not be well buckled at a desired folded position according to the kind of the medium, for example, a paper having a relatively large size or a thin paper having a relatively low firmness, and the deformation occurs at a different portion. Accordingly, it is difficult to accurately obtain a fold line position.

BRIEF SUMMARY OF THE INVENTION

According to an aspect of the invention, a Z-folding apparatus comprises, a pair of feed rollers to transport a sheet along a specified transport passage, a contact portion with which a head of the transported sheet comes in contact, a press member to press a specified position of the sheet apart from the head, and a pair of folding rollers to form a fold line on the sheet and to transport the sheet on which the fold line has been formed, wherein when the head of the sheet comes in contact with the contact portion, the press member presses the specified position of the sheet apart from the head in a transport direction toward the pair of folding rollers, and guides it to a nip between the rollers of the pair of folding rollers.

According to another aspect of the invention, a sheet processing apparatus comprises, a pair of feed rollers that nips and rotates a sheet to transport the sheet, a contact member that is disposed downstream of the pair of feed rollers in a direction of the transport and comes in contact with a head portion of the sheet transported by the pair of feed rollers, a pair of folding rollers a nip of which is disposed at a main surface side of the transported sheet between the pair of feed rollers and the contact member, and which receives the sheet into the nip and folds it, a press member that is provided between the pair of feed rollers and the pair of folding rollers, presses a specified part of the sheet apart from the head toward the pair of folding rollers to form a warp on the sheet and guides a portion deformed into a convex shape toward the nip of the pair of folding rollers, and a coupling member that couples the contact member and the press member, and moves, when the contact member is pressed by the transport of the sheet, the press member in a direction of pressing the sheet toward the folding rollers in synchronization with the pressing of the contact member, wherein a plurality of the pairs of feed rollers, a plurality of the pairs of folding rollers, a plurality of the press members, and a plurality of the coupling members are provided along the direction of the transport, and when an angle between a line connecting axial centers of the pair of feed rollers at an upstream side and a line connecting axial centers of a first pair of folding rollers is $\eta 1$, and an angle between a line connecting axial centers of the pair of feed rollers at a downstream side and the line connecting the axial centers of the first pair of folding rollers is $\eta 2$, the respective rollers are disposed to satisfy a relation of $\eta 1 > \eta 2$.

According to another aspect of the invention, a Z-folding method comprising, transporting a sheet along a specified transport passage by a pair of feed rollers, bringing a head of the transported sheet into contact with a contact portion, pressing, when the head of the sheet comes in contact with the contact portion, a specified position of the sheet apart from the head by a press member that presses the specified position of the sheet apart from the head in a transport direction of the sheet to a side of a pair of folding rollers and guides it to a nip between the rollers of the pair of folding rollers, forming a fold line on the sheet, and transporting, by the folding rollers, the sheet on which the fold line has been formed.

Objects and advantages of the invention will become apparent from the description which follows, or may be learned by practice of the invention

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

First Embodiment

Figure 1:
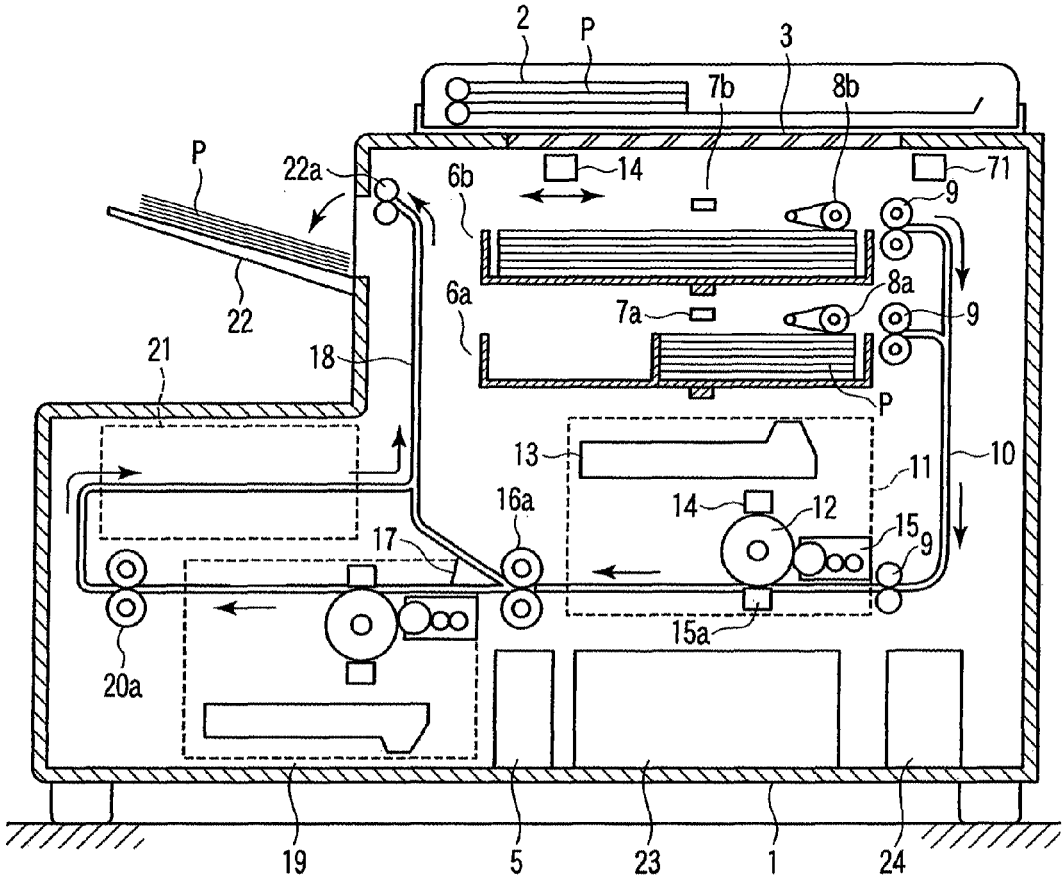
FIG. 1 is an explanation view showing a structure of a digital copier of a first embodiment of the invention.

FIG. 1 shows a schematic structure of a digital copier of an electrophotographic system on which a Z-folding mechanism 21 of this embodiment is installed.

The digital copier includes a housing 1 as an outer shell. An original document table 3 made of transparent glass is provided on the upper surface of the housing 1, and an original document supply section 2 is provided thereon. The original document supply section 2 feeds a plurality of original documents one by one to a specified position on the original document table 3. A scanner 4 which moves right and left in the drawing is provided below the original document table 3. Image data read from an original document through the scanner 4 is stored in a large capacity data file device 5 disposed near the lower end of the housing 1.

Two cassettes 6*a* and 6*b* containing sheets are provided below the scanner 4 so as to be detachable to and attachable from the housing 1. The respective cassettes 6*a* and 6*b* are provided with transmission optical sensors 7*a* and 7*b* to detect the presence or absence of the sheet P, and feed rollers 8*a* and 8*b* to separate the sheets P one by one and to feed it. Incidentally, in this embodiment, the sheet P of A4 size is set in the lower stage cassette 6*a* , and the sheet P of A3 size is set in the upper stage cassette 6*b*. The sheet P fed from each of the cassettes 6*a* and 6*b* is fed to a first image forming unit 11 through a transport path 10 including a plurality of roller pairs 9.

The first image forming unit 11 includes a photoconductive drum 12 at substantially the center thereof, and includes, around it, a laser optical system 13, a charger 14, a developing unit 15, a transfer charger 15*a* and the like. A latent image is formed on the photoconductive drum 12 by exposure scanning of the laser optical system 13 based on image data suitably read out from the data file device 5, the latent image is developed by toner supplied from the developing unit 15, and a toner image is transferred by the transfer charger 15*a* onto the sheet P fed through the transport path 10.

The sheet P on which the toner image has been transferred is fed out from the first image forming unit 11, and is fed to a first fixing device 16. Here, the sheet P is heated and pressed by a heat roller 16*a*, and the toner image is fixed onto the sheet P. The sheet P on which the toner image has been fixed passes through a gate 17 rotated by an actuator.

A second image forming unit 19 having the same structure as the first image forming unit 11 is reversely provided on one transport path switched by the gate 17. That is, an image can be formed also on the other surface of the sheet P on one surface of which an image has been formed by the first image forming unit 11. Besides, a second fixing device 20 including a heat roller 20*a* is disposed downstream of the second image forming unit 19.

A transport path at the downstream side of the second fixing device 20 passes through the after-described Z-folding mechanism 21 and is connected to the other transport path switched by the gate 17. A jointed transport path 18 extends to a pair of discharge rollers 22*a* provided near the upper end of the housing 1, and the sheet P transported through the transport path 18 is discharged to a paper stack tray 22 through the discharge roller 22*a*.

A control unit 23 to control the operation of the digital copier in accordance with a specified operation program and a power source unit 24 to supply electric power to the digital copier are disposed near the bottom of the housing 1. The control unit 23 functions as a control section, a first control section and a second control section of the invention.

Figure 2:
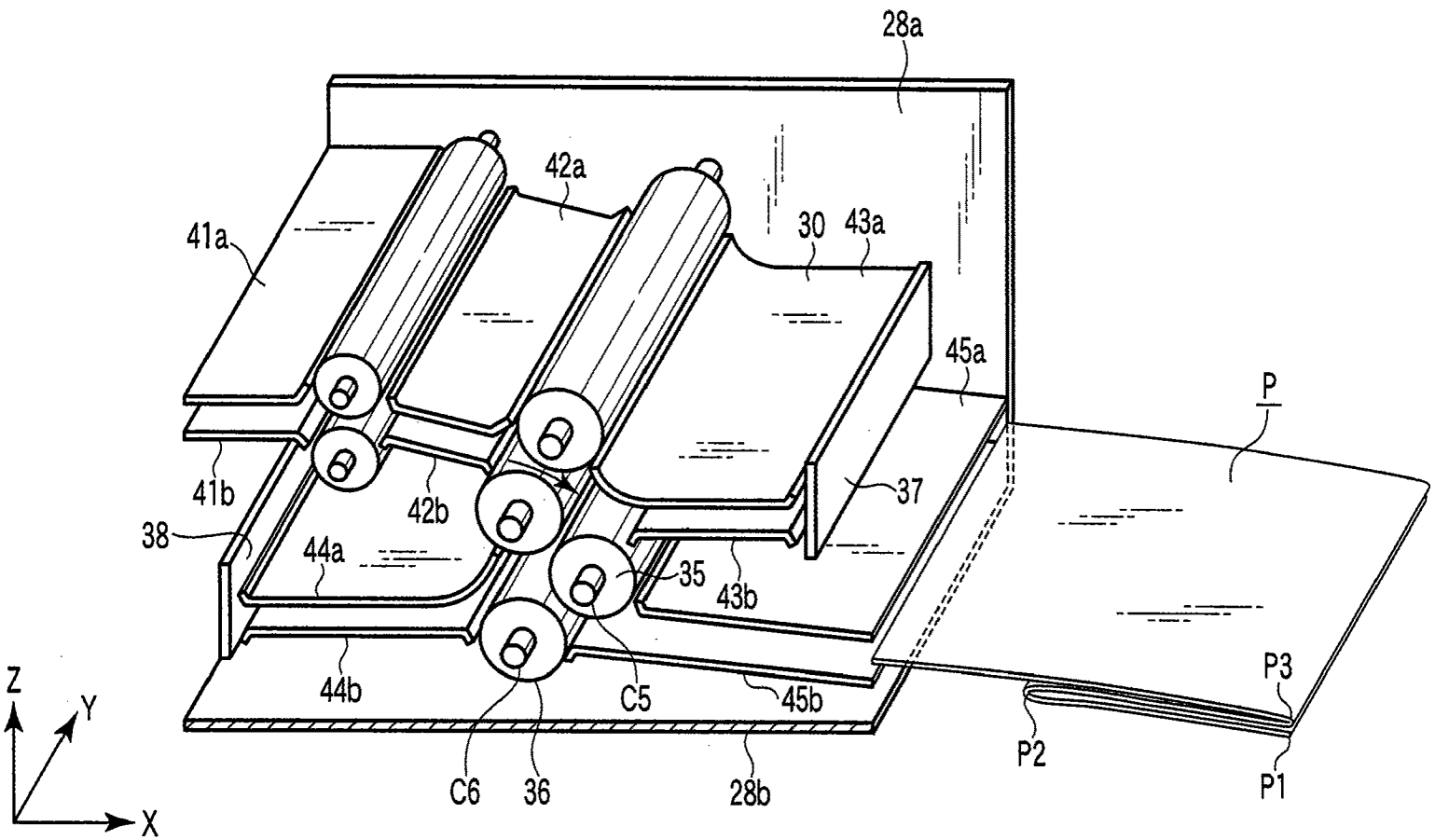
FIG. 2 is a perspective view showing a structure of a Z-folding mechanism of the first embodiment.
Figure 3:
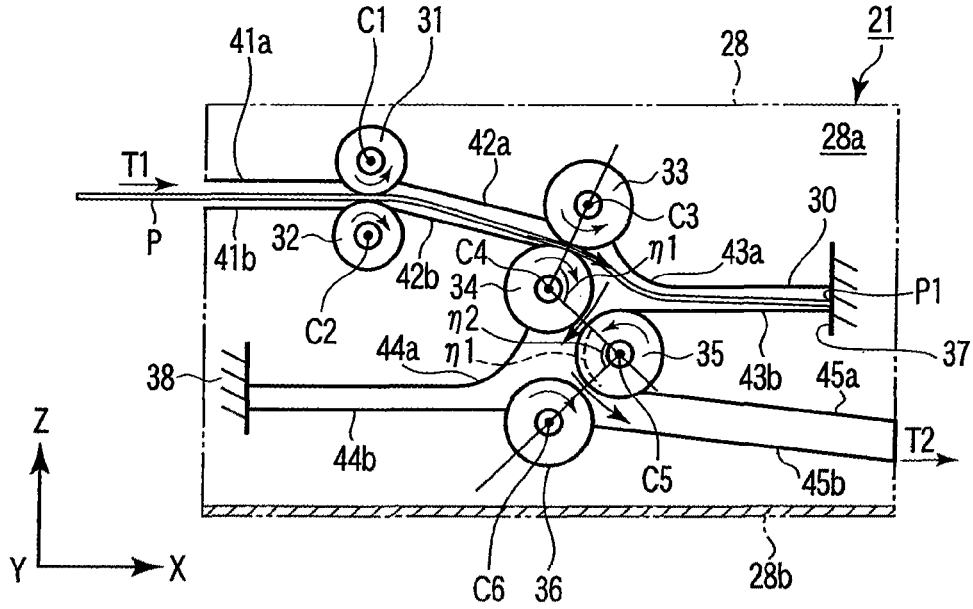
FIG. 3 is a schematic view showing the structure of the Z-folding mechanism of the first embodiment.

FIG. 2 and FIG. 3 show a schematic structure of the Z-folding mechanism 21 as a medium processing apparatus. The Z-folding mechanism 21 includes a base member 28 integrally having a front panel (not shown) provided upright along the housing at the front side of the digital copier, a rear panel 28*a* provided upright along the housing at the rear side of the digital copier, and a bottom plate 28*b* connecting lower ends of the respective panels, and includes a plurality of feed rollers 31 to 36 (described later) extending between the front panel and the rear panel of the base member 28. Each of the feed rollers 31 to 36 is formed by covering a metal shaft with a rubber material. Each of the plurality of feed rollers 31 to 36 is connected to a control unit 23 through a stepping motor. Incidentally, a stepping motor coupled with a plurality of feed rollers may be driven and rotated in common. The feed rollers 31 to 36 are controlled by the control unit 23 and are respectively rotated around shafts C1 to C6 in specified directions, and function to fold the sheet P fed from an arrow T1 direction in the drawing into a Z-shape and to feed it in an arrow T2 direction in the drawing. The rotation directions of the opposed rollers of each roller pair are opposite to each other, and for example, one of the rollers rotates clockwise (first direction) and the other thereof rotates counterclockwise (second direction), so that the sheet is nipped and transported.

The diameters of all the rollers 33 to 36 are equal to one another, and the rotation speeds and the sheet feed speeds are also equal to one another. Incidentally, in the drawing, for explanation, a sheet is shown to be thick, and a nip between a pair of rollers is shown to be wide and opened, however, the rollers are actually in contact with each other.

The sheet P from an inlet portion of the left upper part passes through between the feed rollers 31 and 32 and between the pair of folding rollers 33 and 34, and when the leading edge thereof comes in contact with a first stopper 37, a halfway portion deformed by buckling is folded by the pair of rollers 34 and 35 and is transported, and when the sheet comes in contact with a second stopper 38, a halfway portion warped and deformed by buckling is folded between the pair of folding rollers 35 and 36, and is discharged from a right lower discharged portion in the drawing. A zigzag passage along which the sheet P is transported by a guide plate 41*a* and the like described later is a transport passage 30.

The pair of folding rollers 31 and 32, which are vertically, in the drawing, and rotatably in contact with each other, are provided in the vicinity of the inlet through which the sheet P is fed to the Z-folding mechanism 21. A pair of guide plates 42*a* and 42*b* to guide the upper surface and the lower surface of the sheet P transported rightward in the drawing through a nip are provided at the right side, in the drawing, of the nip of the pair of feed rollers 31 and 32, that is, at the downstream side in the transport direction of the sheet P, and the pair of folding rollers 33 and 34, which are vertically, in the drawing, and rotatably in contact with each other, are provided at the downstream side of the guide plates 42*a* and 42*b*. Incidentally, the pair of folding rollers 33 and 34 directly transports the sheet P received through the inlet along the transport passage 30, and the transport direction at the nip of the pair of folding rollers 33 and 34 is made a first direction. The roller 33 functions as a first roller, and the roller 34 functions as a second roller.

The first stopper 37 having a wall surface vertical to an X direction in the drawing is disposed at the downstream side of the nip of the pair of folding rollers 33 and 34, that is, at the right side in the drawing. The first stopper 37 functions as a first abutment portion.

Guide plates 43*a* and 43*b* to guide the transported sheet P are provided between the pair of folding rollers 33 and 34 and the first stopper 37. The guide plate 43*a* is curved in a direction in which the sheet P is nipped and transported by the pair of folding rollers 34 and 35, and has a function to guide the deformation of the sheet P.

The folding roller 35, which is rotatably in contact with the right side of the folding roller 34 in the drawing, is provided below the guide plate 43*a*. The folding roller 35, together with the folding roller 34, functions as a first pair of folding rollers of the invention, and functions to receive and fold, by the nip, the convex side of the deformed portion of the sheet P warped and deformed toward the lower surface (first surface) side between the pair of folding rollers 33 and 34 and the first stopper 37, and to transport the folded sheet P in a second direction while the folded part is made the head.

Incidentally, the folding roller 34, together with the folding roller 33, functions as a first pair of feed rollers of the invention, and the folding roller 34, together with the folding roller 35, functions also as a first pair of folding rollers of the invention. That is, by adopting the structure as stated above, the nip of the pair of folding rollers 33 and 34 and the nip of the pair of folding rollers 34 and 35 can be made to approach each other, and the structure can be simplified. Incidentally, the nip of the folding rollers 34 and 35 is disposed at the convex side of the deformation of the sheet.

The second stopper 38 functioning as a second abutment portion is disposed at the downstream side of the nip between the pair of folding rollers 34 and 35. Incidentally, the sheet P passing through the nip of the pair of folding rollers 34 and 35 and transported leftward in the drawing is transported while the folded position (first folded position) is made the head, and is fed to the second stopper 38.

Guide plates 44*a* and 44*b* to guide the transported sheet P are provided between the pair of folding rollers 34 and 35 and the second stopper 38. The guide plate 44*a* is curved toward the transport direction of the sheet P between the folding rollers 35 and 36 and has a function to guide the deformation of the sheet P.

The folding roller 36, which is rotatably in contact with the lower part of the folding roller 35 in the drawing, is disposed at the right lower part, in the drawing, of the guide plate 44*b*. The folding roller 36, together with the folding roller 35, functions as a second pair of folding rollers of the invention, and functions to receive and to fold, by the nip, the convex side of the deformed portion of the sheet P warped and deformed rightward in the drawing between the pair of folding rollers 34 and 35 and the second stopper, and to transport it in a third direction, that is, in the right direction in the drawing while the folded part is made the head. Incidentally, the roller 35 functions as a third roller, and the roller 36 functions as a fourth roller. The nip of the pair of rollers 35 and 36 is disposed at the convex side of the deformation of the sheet.

The folding roller 35, together with the folding roller 34, functions as a second pair of feed rollers, and the folding roller 35, together with the folding roller 36, functions also as a second pair of folding rollers. That is, by adopting the structure as stated above, the nip of the pair of folding rollers 34 and 35 and the nip of the pair of folding rollers 35 and 36 can be made to approach each other to facilitate guiding of the sheet, and the structure can be simplified.

A pair of guide plates 45*a* and 45*b* to horizontally guide the sheet P folded twice into the Z-shape are provided at the right side, in the drawing, of the nip of the pair of folding rollers 35 and 36. That is, the Z-folded sheet P passing through the nip of the pair of folding rollers 35 and 36 is guided by the pair of guide plates 45*a* and 45*b*, and is transported and sent to the outside of the Z-folding mechanism 21 in the arrow T2 direction.

At least the three folding rollers 34, 35 and 36 among the plurality of feed rollers are formed into cylindrical shapes of lengths exceeding at least the whole width of the sheet P. That is, the sheet P is folded when the warped portion of the sheet P passes through the nip between the pair of folding rollers 34 and 35, and the sheet P is folded when the warped portion of the sheet P passes through the nip between the pair of folding rollers 35 and 36, and accordingly, the three feed rollers have the shape in which the sheet P can be nipped and pressed over the whole length thereof. On the other hand, the other feed roller, for example, the feed roller 31, 32 or 33 is constructed to have a plurality of divided roller portions along its rotation axis.

The plurality of pairs of feed rollers are disposed such that as the number of folded sides increases, an angle formed by connecting the centers of the pairs of rollers becomes small. That is, when an angle between a line connecting the center of the folding roller 33 and the center of the folding roller 34 and a line connecting the center of the roller 34 and the center of the roller 35 is $\eta 1$, and an angle between the line connecting the center of the roller 34 and the center of the roller 35 and a line connecting the center of the roller 35 and the center of the roller 36 is $\eta 2$, the rollers are disposed so that $\eta 1 > \eta 2$ is established.

In other words, the angle formed by the first direction as the feed direction of the folding rollers 33 and 34 and the second direction as the feed direction of the folding rollers 34 and 35 is larger than the angle formed by the second direction and the third direction as the feed direction of the folding rollers 35 and 36.

Next, the folding operation of the sheet P by the Z-folding mechanism 21 of the above structure will be described with reference to FIG. 4 to FIG. 7. Here, as an example, a description will be given to a case where in the digital copier, a sheet of A4 size and a sheet of A3 size are handled, the sheet of A3 size is fed to the Z-folding mechanism 21 and is folded into the Z-shape, is made uniform to have A4 size, and is discharged. As stated above, since the sheets different in size are made uniform in size and can be discharged, a post-process in a finisher, such as stapling or punching, becomes easy.

Before the folding operation, an operator inputs various settings to determine the size of the sheet P, the folding position and the like through a setting input section 71 (see FIG. 1). The setting input section 71 is connected to the control unit 23 of the digital copier.

When the first and the second folded position are set, the stepping motor (not shown) coupled to each of the rollers 31 to 36 is normally rotated, the feed rollers 31 to 36 are rotated in the arrow directions in the drawing, and the sheet P is fed to the Z-folding mechanism 21 in the arrow T1 direction. The sheet P passes through between the feed rollers 31 and 32, advances in the right direction in FIG. 3, passes through between the folding rollers 33 and 34 and is transported in the first direction. When the sheet is further transported along the transport passage 30 in the right direction in the drawing, at last, as shown in FIG. 3, the leading edge P1 of the sheet P comes in contact with the first stopper 37 and is regulated.

In this state, when the rollers 33 and 34 are rotated and the sheet is further fed, a halfway portion of the sheet P is deformed by buckling toward the lower surface side between the nip of the pair of folding rollers 33 and 34 and the first stopper 37. At this time, the sheet P is guided by the guide plate 43*a* provided at the upper surface side of the sheet P so that the sheet is buckled toward the lower surface (first surface) side and toward the second direction, and the buckled portion is guided to the nip of the pair of folding rollers 34 and 35.

Figure 4:
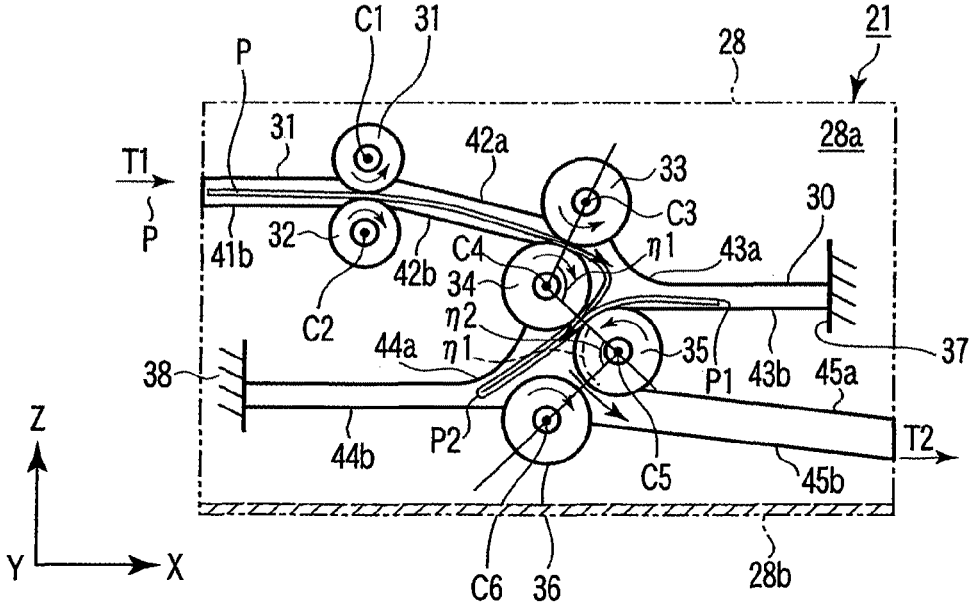
FIG. 4 is an explanatory view showing a processing process in the Z-folding mechanism of the first embodiment.

As shown in FIG. 4, the sheet P guided to the nip of the pair of folding rollers 34 and 35 passes through the nip and is folded, and is fed leftward while the first folded position P2 is made the head.

Figure 5:
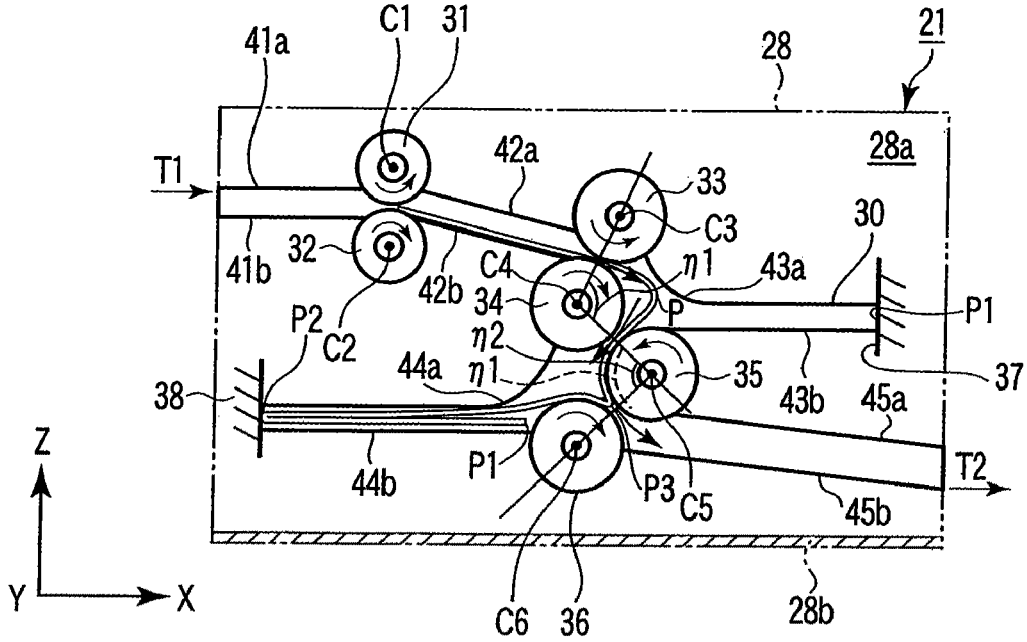
FIG. 5 is an explanatory view showing the processing process in the Z-folding mechanism of the first embodiment.

When the sheet P is further fed leftward, as shown in FIG. 5, the first folded position P2 as the head comes in contact with the second stopper 38, and is regulated. In this state, the pair of folding rollers 34 and 35 is further rotated, and when the trailing edge side of the sheet P is fed in the direction of the second stopper 38 side, that is, in the left direction, a halfway portion of the sheet P is deformed by buckling toward the right lower side in the drawing between the nip of the folding rollers 34 and 35 and the second stopper 38.

At this time, the sheet P is deformed toward the right lower side by the guide plate 44*a* provided at the upper side of the sheet P in the drawing, and the deformed portion is guided to the nip of the pair of folding rollers 35 and 36.

Figure 6:
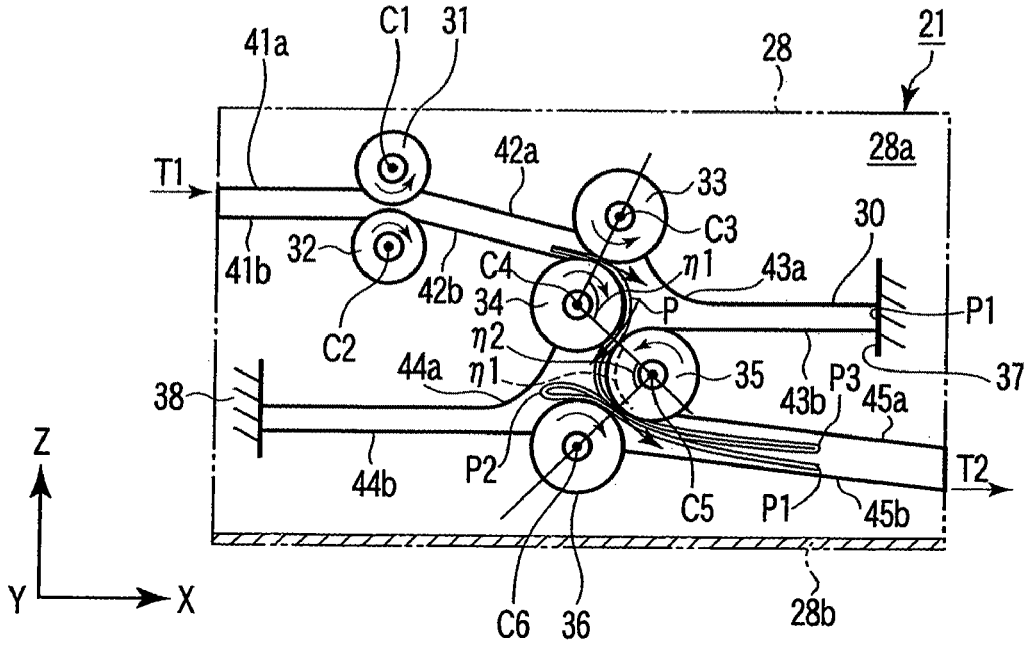
FIG. 6 is an explanatory view showing the processing process in the Z-folding mechanism of the first embodiment.

The sheet P guided to the nip of the pair of folding rollers 35 and 36 passes through the nip and is folded as shown in FIG. 6, and is fed in the right direction in the drawing while a second folded position P3 is made the head.

Figure 7:
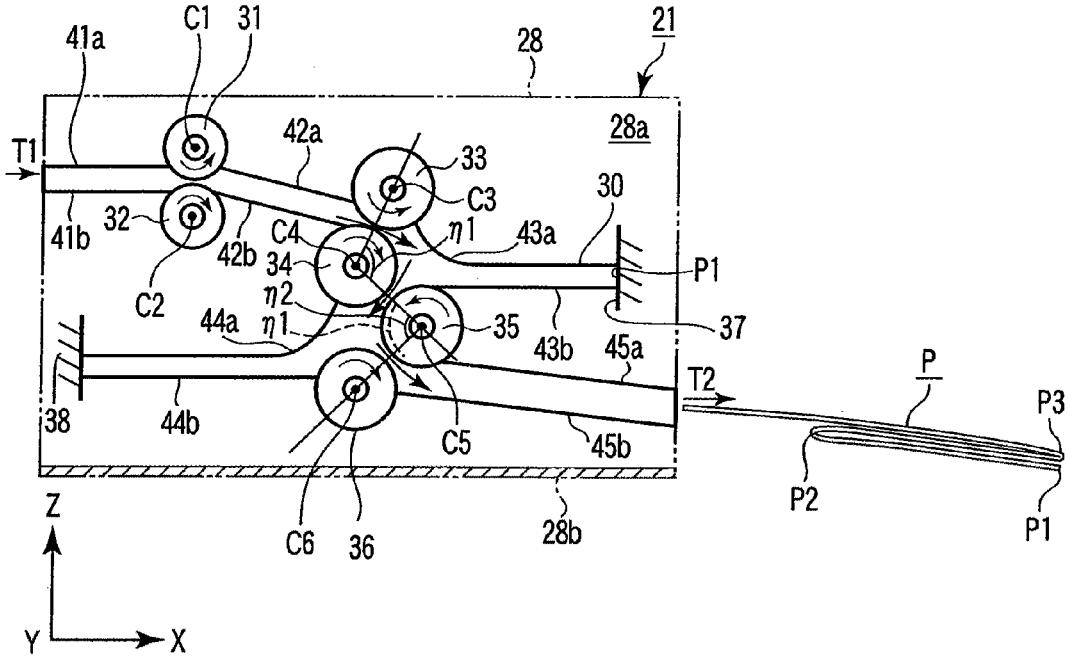
FIG. 7 is an explanatory view showing the processing process in the Z-folding mechanism of the first embodiment.

The sheet P fed in the right direction in the drawing through the nip of the pair of folding rollers 35 and 36 is fed out as a sheet P' folded into the Z-shape from the Z-folding mechanism 21 in the arrow T2 direction as shown in FIG. 7.

That is, the medium processing apparatus of the embodiment includes the folding rollers 33, 34, 35 and 36, and among them, the pair of rollers 34 and 35 and the pair of rollers 35 and 36 are the pair of folding rollers. The pair of folding rollers 33 and 34, the first stopper 37, and the pair of folding rollers 34 and 35 constitute a first folding unit. Besides, the pair of folding rollers 34 and 35, the second stopper 38 and the pair of rollers 35 and 36 as the pair of folding rollers constitute a second folding unit.

When the first part is folded by the first folding unit, the sheet transported by the pair of rollers 33 and 34 comes in contact with the stopper 37, the buckled and warped portion is nipped by the pair of rollers 34 and 35 to form a fold line, and the fold line is transported to the stopper 38. Similarly, when the second part is folded by the second folding unit, the sheet transported by the pair of rollers 34 and 35 comes in contact with the stopper 38, the buckled and warped portion is nipped by the pair of rollers 35 and 36 to form a fold line and is transported.

When the sheet passes through between the pair of rollers 33 and 34, since there is no folded side, the thickness is equal to the thickness of one sheet P, however, since the sheet is once folded between the rollers 34 and 35, the thickness becomes equal to that of two sheets, and further, since the sheet is folded twice between the rollers 35 and 36, the thickness becomes equal to that of three sheets.

Here, when the angle formed by the line connecting the centers of the rollers 33 and 34 and the line connecting the centers of the rollers 34 and 35 is $\eta 1$, and the angle formed by the line connecting the centers of the rollers 34 and 35 and the line connecting the centers of the rollers 35 and 36 is $\eta 2$, $\eta 1 > \eta 2$ is established. By adopting the structure as stated above, it becomes easy to climb over the folded side having the increased thickness. That is, the sheet P which is folded and the thickness of which is increased becomes hard to warp, and particularly, the inside sheet inside of the warp becomes hard to nip, however, by the above structure, the sheet P in which two or more sheets overlap with each other becomes easy to buckle toward the direction of the folding rollers, the sheet can be smoothly transported to the pair of folding rollers 35 and 36. Thus, it becomes possible to prevent the shift of folded position, defective feeding, and the occurrence of wrinkles and dog-ears, and the process can be performed with high accuracy.

Second Embodiment

Hereinafter, a Z-folding mechanism 21 of a second embodiment of the invention will be described with reference to FIG. 8. Incidentally, since this embodiment is similar to the first embodiment except for the structure of a roller pair, similar parts are denoted by the same reference numerals and their explanation will be omitted. Incidentally, in the drawing, for explanation, a sheet is shown to be thick, and a nip between a pair of rollers is shown to be wide and opened, however, the rollers are actually in contact with each other.

In the Z-folding mechanism of this embodiment, diameters of a plurality of rollers 33 to 36 vary according to positions, and when radii of the folding rollers 33 to 36 are respectively made r3 to r6, the structure is made such that r3<r4<r5<r6 is established. Feed speeds of opposed rollers among the rollers 33 to 36 are equal to each other. For example, in the case of the rollers where a motor is common and the roller diameters are different from each other, a gear ratio is set so that the feed speeds become equal to each other.

Figure 8:
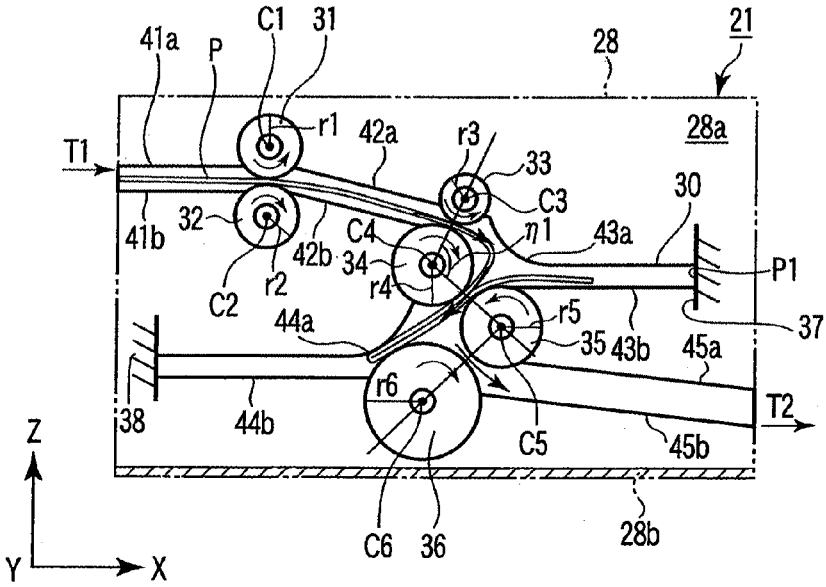
FIG. 8 is a schematic view showing a structure of a Z-folding mechanism of a second embodiment of the invention.
Figure 9:
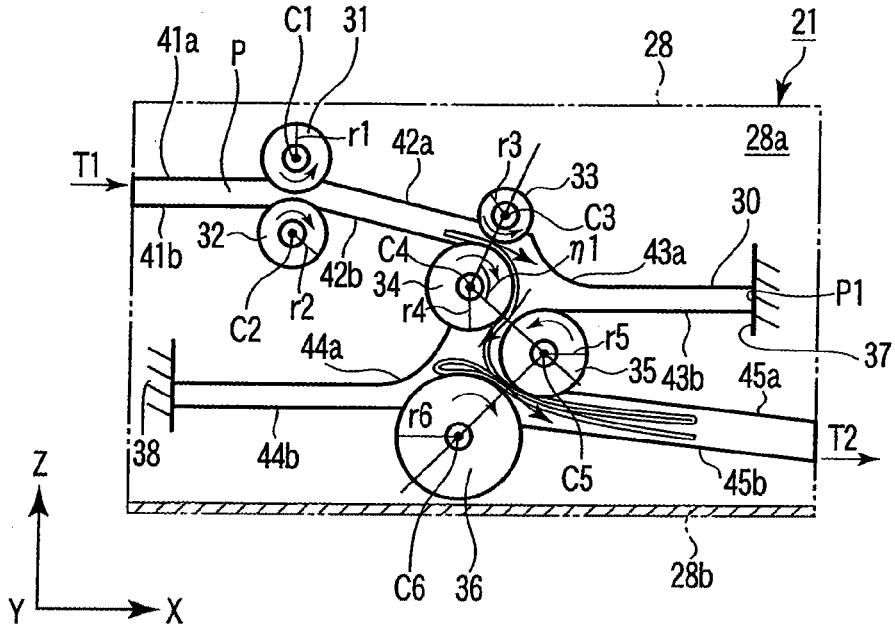
FIG. 9 is an explanatory view showing a processing process of the Z-folding mechanism of the second embodiment.

Similarly to the first embodiment, also in the Z-folding mechanism of this embodiment, when the first part is folded, as shown in FIG. 8, a sheet transported by the pair of rollers 33 and 34 comes in contact with a stopper 37, a buckled and warped place is nipped by the pair of rollers 34 and 35 to form a fold line, and the fold line is transported to a stopper 38. Similarly, as shown in FIG. 9, with respect to the second part, a fold line is formed by the pair of rollers 35 and 36, and a transport process is performed.

Since there is no folded side when the sheet passes through between the pair of rollers 33 and 34, the thickness is equal to one sheet P, and when the sheet passes through between the pair of rollers 34 and 35, since the sheet is once folded, the thickness becomes equal to that of two sheets, and when the sheet passes through between the rollers 35 and 36, since the sheet is folded twice, the thickness becomes equal to that of three sheets.

Here, the structure is made such that as the thickness of the sheet becomes large, the size of the roller to nip the sheet becomes large, and accordingly, it becomes easy to nip the buckled part of the sheet. Therefore, it becomes possible to easily nip and transport the sheet whose thickness is increased by folding.

That is, even if the number of fold lines is increased, and the thickness of the sheet is increased, the effect of facilitating the guide of the buckled portion to the nip of the pair of folding rollers is obtained. For example, with reference to FIG. 8, by establishing a relation of r3<r4<r5<r6, when the sheet is guided to the nip by the rotation of the rollers and by using the friction, it becomes easy to guide the folded surface of the sheet to the nip (for example, between the rollers 35 and 36) of the pair of folding rollers.

Also in the Z-folding mechanism 21 of this embodiment, the same effect as the first embodiment is obtained. That is, since the diameters of the rollers are made different from each other, it becomes possible to easily transport the sheet whose thickness is increased by folding, and therefore, the accurate folded position can be obtained, the transport process with high accuracy becomes possible, and it is possible to prevent the occurrence of dog-ears and wrinkles.

Incidentally, in this embodiment, the description has been given to the case of r3<r4<r5<r6, also in the case of r3=r4<r5<r6, the case of r3=r4=r5<r6, or the case of r3<r4=r5<r6, the same effect can be obtained. However, the effect at the time when the sheet is guided to the first folded position is higher in the case of r4<r5.

Third Embodiment

Hereinafter, a Z-folding mechanism of a third embodiment of the invention will be described with reference to FIG. 10. Incidentally, since this embodiment is similar to the first embodiment except that auxiliary mechanisms 60 and 65 are provided, an explanation of similar parts will be omitted. Besides, in the drawing, for explanation, a sheet is shown to be thick, and a nip between a pair of rollers is shown to be wide and opened, however, the rollers are actually in contact with each other.

Figure 10:
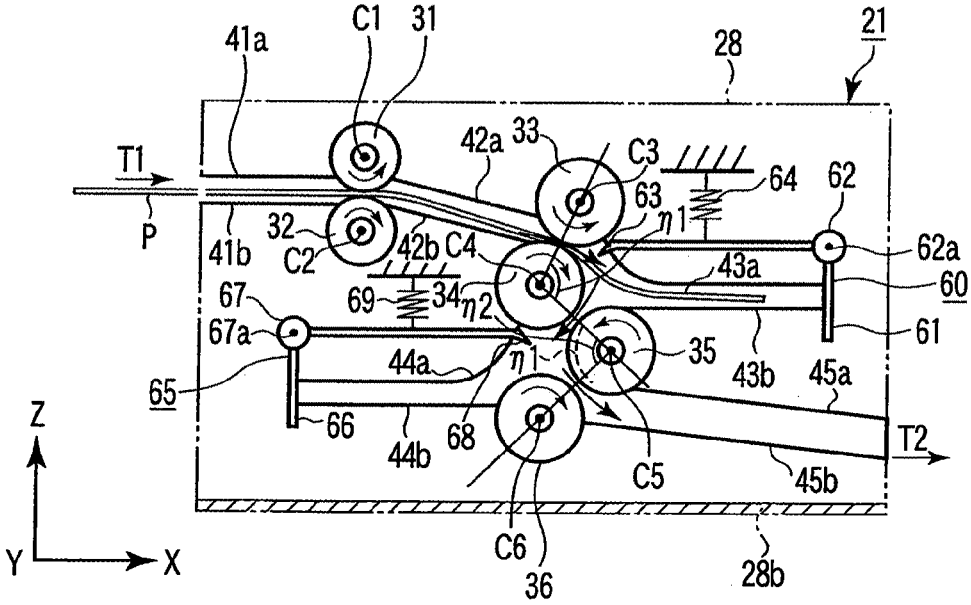
FIG. 10 is a schematic view showing a structure of a Z-folding mechanism of a third embodiment of the invention.

As shown in FIG. 10, in the Z-folding mechanism 21 of this embodiment, the auxiliary mechanisms 60 and 65 to assist the warp deformation of the sheet are provided at two folding positions. The feed speeds of rollers 33 to 36 of this embodiment are set to be equal to one another.

The auxiliary mechanism 60 includes a contact member 61 with which the head of a transported sheet comes in contact and which is pressed by the sheet, a link member 62 which is connected to the contact member 61 and is rotatably provided to a base member 28, a blade section 63 which is connected to the contact member 61 through the link member 62 and functions as a press member to press the sheet to the nip of the pair of rollers 34 and 35, and an urging part 64 for urging the blade section 63 in the direction of retracting from the sheet.

Similarly to the first stopper 37, the contact section 61 is provided on a transport passage, functions to regulate the transport of the head portion of the sheet, and is pressed by the transported sheet P so that it is displaced rightward in the drawing against the urging force of the urging part 64.

The link member 62 is provided to the base member 28 so as to be rotatable around a rotation shaft 62*a* extending in the Y direction of the drawing. One side of the link member extends downward and is connected to the contact member 61. The other side of the link member extends obliquely leftward downward and is connected to the blade section 63.

When the contact member connected to the one side is pressed rightward by the transport force of the sheet, the link member 62 is rotated counterclockwise around the rotation shaft 62*a*, and the blade section coupled to the other side is moved obliquely leftward downward, so that the link member functions to press the sheet.

The blade section 63 is provided at a part positioned downstream of the pair of folding rollers 33 and 34 and upstream of the pair of folding rollers 34 and 35. The blade section 63 functions as a press member to press the folded portion of the sheet in a second direction as a deformation direction, that is, obliquely leftward downward.

In the case where the contact section 61 is not pressed by the sheet, the blade section 63 is urged by the urging part 64 into the initial state, that is, in the direction in which the blade section 63 is retracted from the sheet.

The auxiliary mechanism 65 is constructed similarly to the auxiliary mechanism 60 except for the arrangement and movement direction. That is, the auxiliary mechanism 65 includes a contact member 66 with which the head of the transported sheet comes in contact and which is pressed by the sheet, a link member 67 which is connected to the contact member 66 and is rotatably provided to the base member 28, a blade section 68 which is connected to the contact member 66 through the link member 67 and functions as a press member to press the sheet to the nip of the pair of rollers 35 and 36, and an urging part 69 for urging the blade section 68 in the direction of retracting from the sheet.

The contact section 66 is provided on the transport passage similarly to the second stopper 38, functions to regulate the transport of the head portion of the sheet, and is pressed by the transported sheet P so that it is displaced leftward in the drawing against the urging force of the urging part 69.

The link member 67 is provided to the base member 28 so as to be rotatable around a rotation shaft 67*a* extending in the Y direction of the drawing. One side of the link member 67 extends downward and is connected to the contact member 65. The other side of the link member 67 extends obliquely rightward downward, and is connected to the blade section 68.

When the contact member connected to the one side is pressed leftward by the transport force of the sheet, the link member 67 rotates clockwise around the rotation shaft 67*a*, and the blade section coupled to the other side is moved obliquely rightward downward, so that the link member functions to press the sheet.

The blade section 68 is provided at a part positioned downstream of the pair of folding rollers 34 and 35 and upstream of the pair of folding rollers 35 and 36. The blade section 68 functions as a press member to press the folded portion of the sheet in a third direction as a deformation direction, that is, obliquely rightward downward.

The positions of the contact members 61 and 66, the urging forces of the urging parts 64 and 69, the extension directions and positions of the blade sections 63 and 68 and the like are appropriately calculated and determined according to the conditions of the shape and properties of the sheet, the position of the fold line, the transport speed and the like, so that the blade member presses and guides the desired fold line position to the desired nip by the transport of the sheet.

Next, the operation of the Z-folding mechanism 21 of this embodiment will be described with reference to FIG. 10 to FIG. 12. FIG. 10 shows the initial state, that is, the state where the sheet does not reach the contact member 61. Here, the state is such that the auxiliary mechanisms 60 and 65 are retracted from the sheet by the urging parts 64 and 69.

Figure 11:
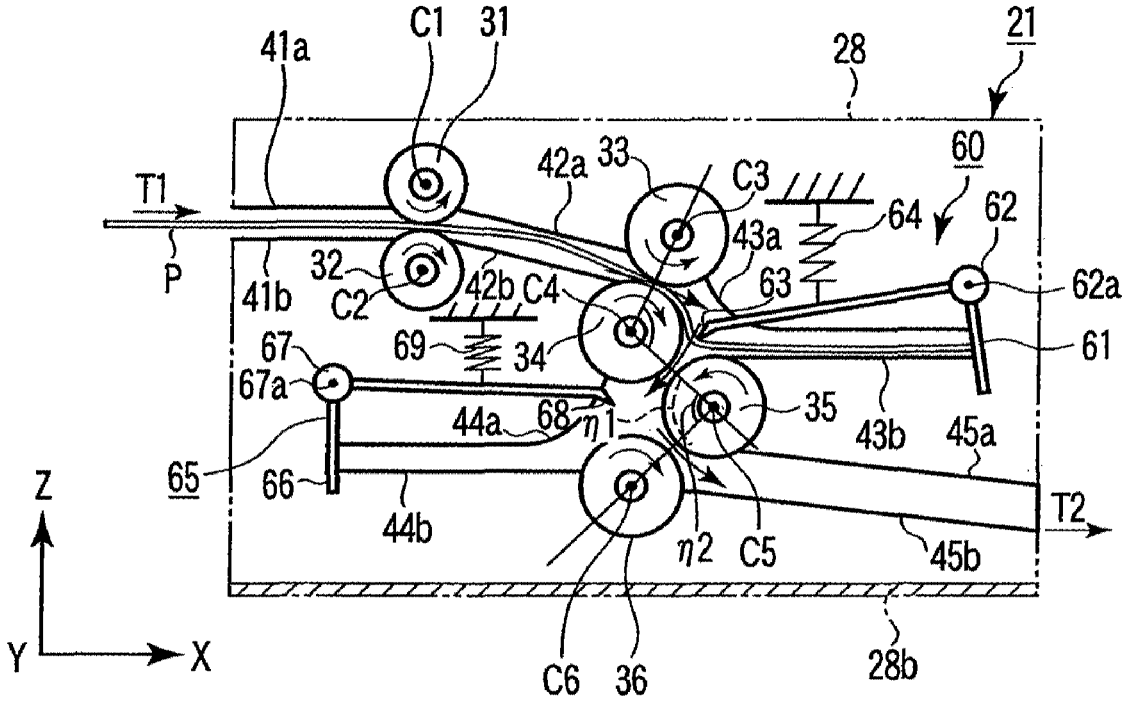
FIG. 11 is an explanatory view showing a processing process in the Z-folding mechanism of the third embodiment.

As shown in FIG. 11, the sheet P is transported by the pair of rollers 33 and 34 and when the sheet is further transported after the head thereof comes in contact with the contact member 61, the contact member 61 moves rightward by the transport force against the urging force of the urging part 64. At this time, the link member 62 rotates, and the blade section 63 moves obliquely leftward downward, and presses the halfway portion of the sheet P obliquely leftward downward toward the pair of rollers 34 and 35 as the pair of folding rollers, that is, in the third direction. Thus, the deformation of the sheet is guided to the nip of the pair of rollers 34 and 35.

The warped portion of the sheet deformed toward the second direction is nipped and transported by the pair of rollers 34 and 35, and a fold line is formed. The sheet P is further transported by the rotation of the pair of rollers 34 and 35 to the contact member 65 while the fold line position (first fold line position) is made the head.

On the other hand, when the leading edge P1 of the sheet P is separated from the contact section 61 by this transport, the auxiliary mechanism 60 is returned to the initial state by the urging force of the urging part 64.

Figure 12:
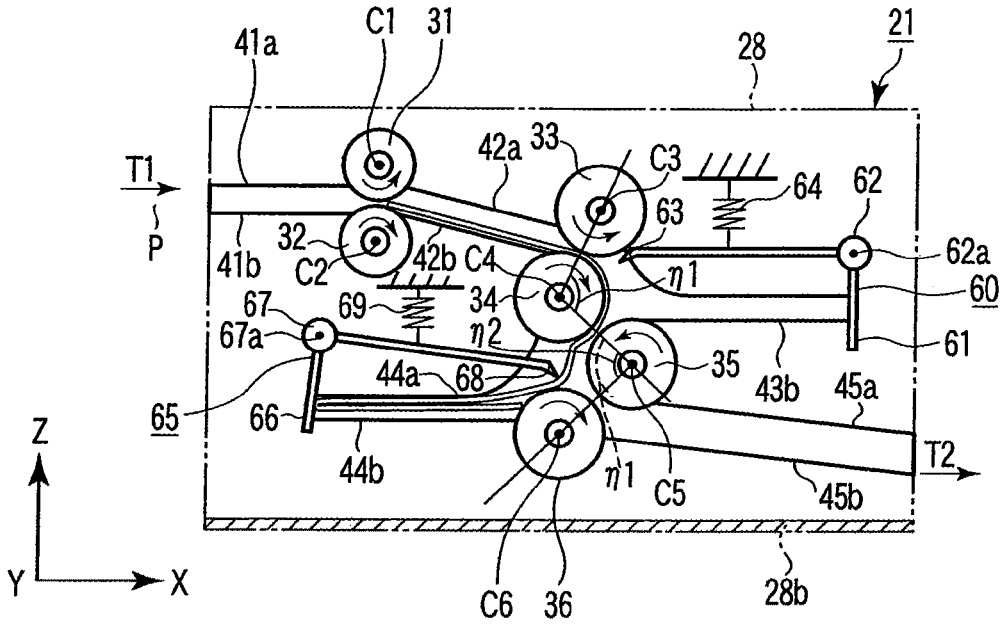
FIG. 12 is an explanatory view showing the processing process in the Z-folding mechanism of the third embodiment.

As shown in FIG. 12, when the head of the sheet P comes in contact with the contact member 65 and is further transported, the contact member 65 is moved leftward by the transport force against the urging force of the urging part 69. At this time, the link member 67 rotates, and the blade section 68 moves obliquely rightward downward, and presses a halfway portion of the sheet P obliquely rightward downward toward the pair of rollers 35 and 36 as the folding roller pair, that is, in the third direction. Thus, the deformation of the sheet is guided to the nip of the pair of rollers 35 and 36.

The warped portion of the sheet deformed toward the third direction is nipped and transported by the pair of rollers 35 and 36, and a fold line is formed. The sheet P is further transported rightward by the rotation of the pair of rollers 35 and 36 while the fold line position (second fold line position) is made the head, and is discharged in a T2 direction.

On the other hand, when the first fold line position of the sheet P is separated from the contact section 66 by this transport, the auxiliary mechanism 65 is returned to the initial state by the urging force of the urging part 69.

The Z-folding mechanism 21 of this embodiment has following effects. That is, by the above structure, it is possible to assist the warp deformation of the sheet in the transport passage into the desired shape, and the accurate fold line can be obtained. Besides, since the stopper position and the blade member are merely connected by the link member, complicated control is unnecessary.

Fourth Embodiment

Hereinafter, a Z-folding mechanism 21 of a fourth embodiment of the invention will be described with reference to FIG. 13. Incidentally, since this embodiment is similar to the first to the third embodiments except for a structure of a guide plate of a transport passage, an explanation of similar parts will be omitted. Besides, in the drawing, for explanation, a sheet is shown to be thick, and a nip between a pair of rollers is shown to be wide and opened, however, the rollers are actually in contact with each other.

Figure 13:
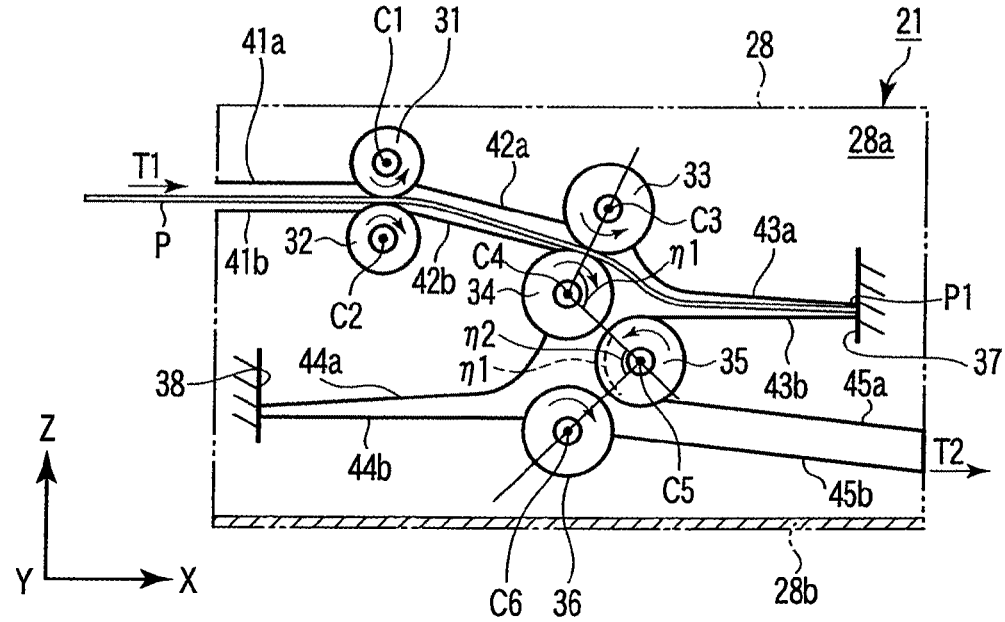
FIG. 13 is a schematic view showing a structure of a Z-folding mechanism of a fourth embodiment of the invention.

As shown in FIG. 13, the Z-folding mechanism 21 of the embodiment is formed such that a transport passage 30 becomes narrow in the vicinity of a stopper 37, 38. That is, an upper guide plate 43*a* is inclined downward toward the right. On the other hand, a lower guide plate 43*b* extends horizontally. Accordingly, the distance between the guide plate 43*a* and the guide plate 43*b* becomes small toward the first stopper 37, and the transport passage is constructed to become narrow like a taper.

On the other hand, an upper guide plate 44*a* is inclined downward toward the left. A lower guide plate 44*b* extends horizontally. Accordingly, the distance between the guide plate 44*a* and the guide plate 44*b* becomes small toward the second stopper 38, and the transport passage 30 is constructed to become narrow like a taper.

In the Z-folding mechanism 21 of the above structure, when the sheet P is transported, the position with which the head thereof comes in contact is regulated. That is, since areas where the sheet P can come in contact with the first and the second stoppers 37 and 38 are small and are restricted, a suitable folded position according to the length of the sheet P can be determined with high accuracy.

That is, in the case where the areas where the sheet P can come in contact with the first and the second stoppers 37 and 38 are large, the condition of deformation of the sheet P is changed according to a portion thereof with which the sheet comes in contact, and accordingly, there is a case where the nip, that is, the fold line position is shifted, however, in this embodiment, the shift of the fold line position can be prevented.

Accordingly, according to the Z-folding mechanism 21 of the embodiment, the accurate folded position can be obtained, the transport process with high accuracy becomes possible, and the occurrence of dog-ears and wrinkles can be prevented.

Incidentally, the invention is not limited to the foregoing respective embodiments, but can be variously modified in the scope of the invention. For example, in the embodiments, although the structure has been described in which the sheet is folded by the two folding units, the invention can be applied to an apparatus including three or more similar folding units.

Figure 14:
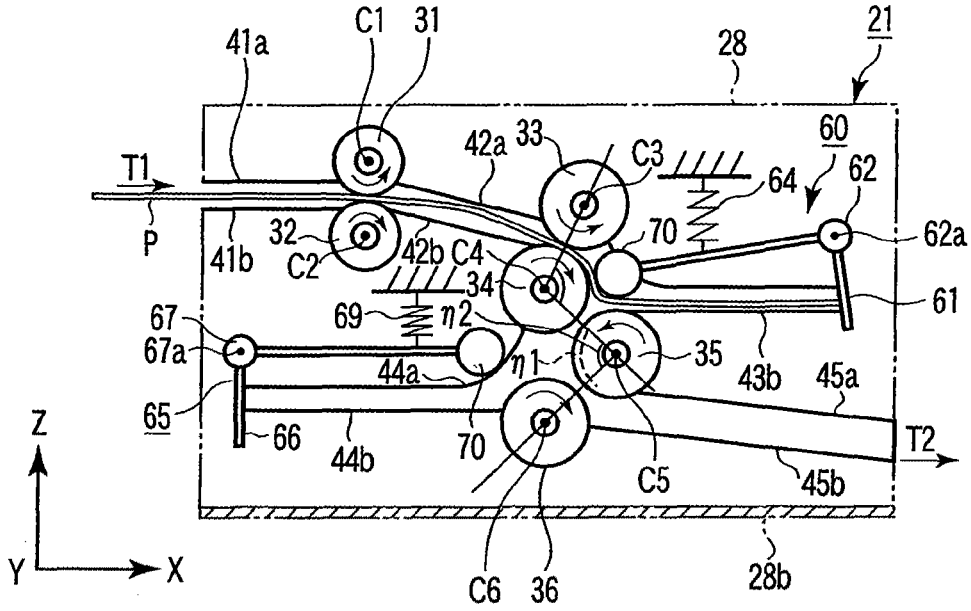
FIG. 14 is a schematic view showing a structure of a Z-folding mechanism of another embodiment of the invention.

Besides, in the third embodiment, although the blade 63 is applied as the press member, as shown in FIG. 14, the structure may be made such that pressing is performed by a cylindrical roller 70 extending in an axial direction. Alternatively, the shape may be spherical. Also in this case, the same effect as the third embodiment can be obtained. Besides, since the outer periphery of the roller 70 is curve-shaped, when the sheet P is deformed, the sheet can be guided so as to be curved and deformed along the roller 70 into the desired shape.

Figure 15:
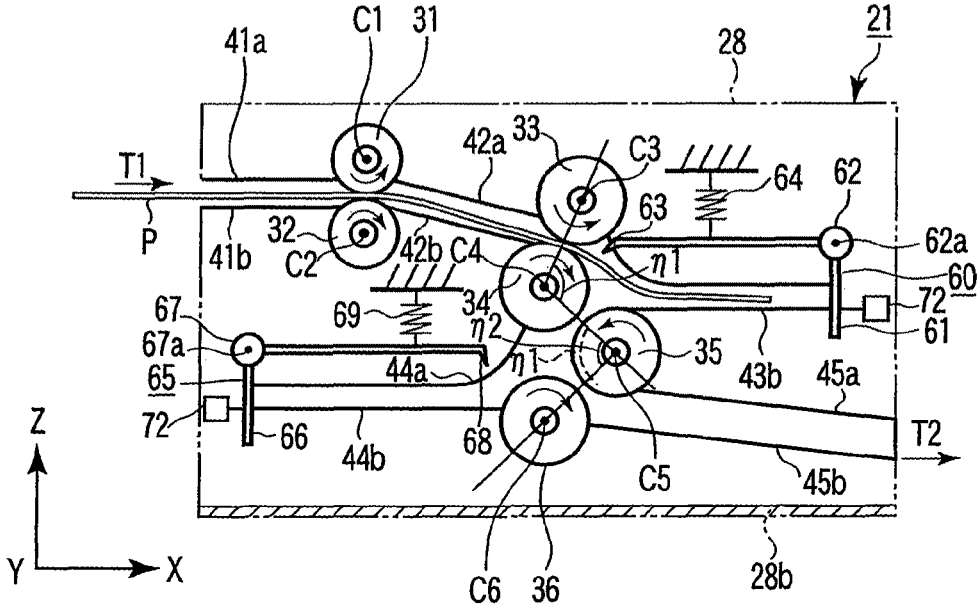
FIG. 15 is a schematic view showing a structure of a Z-folding mechanism of another embodiment of the invention.

Further, in the third embodiment, although the description has been given to the structure in which the press member 63, 68 and the contact member 61, 66 are coupled by the link member 62, 67, and the press member is moved in synchronization with the contact member 61, 66, no limitation is made to this, and the structure may be made such that the press member 63, 68 is constructed to be movable, and the press member 63, 68 is operated according to the contact by the control of, for example, the control unit 23. Here, for example, as shown in FIG. 15, a detection section 72 is provided to a contact member 61, 66, and when the contact of a sheet is detected by the detection section 72, a detection signal is sent to the control unit 23, and the press member 63, 68 is controlled and is moved through a not-shown drive section by the control unit 23 based on the signal.

Further, the first and the second stopper 37 and 38 may be made movable according to a setting change or the control of the control unit 23, and the adjustment of a folded position may be made possible, so that plural kinds of sheets can be handled.

Figure 16:
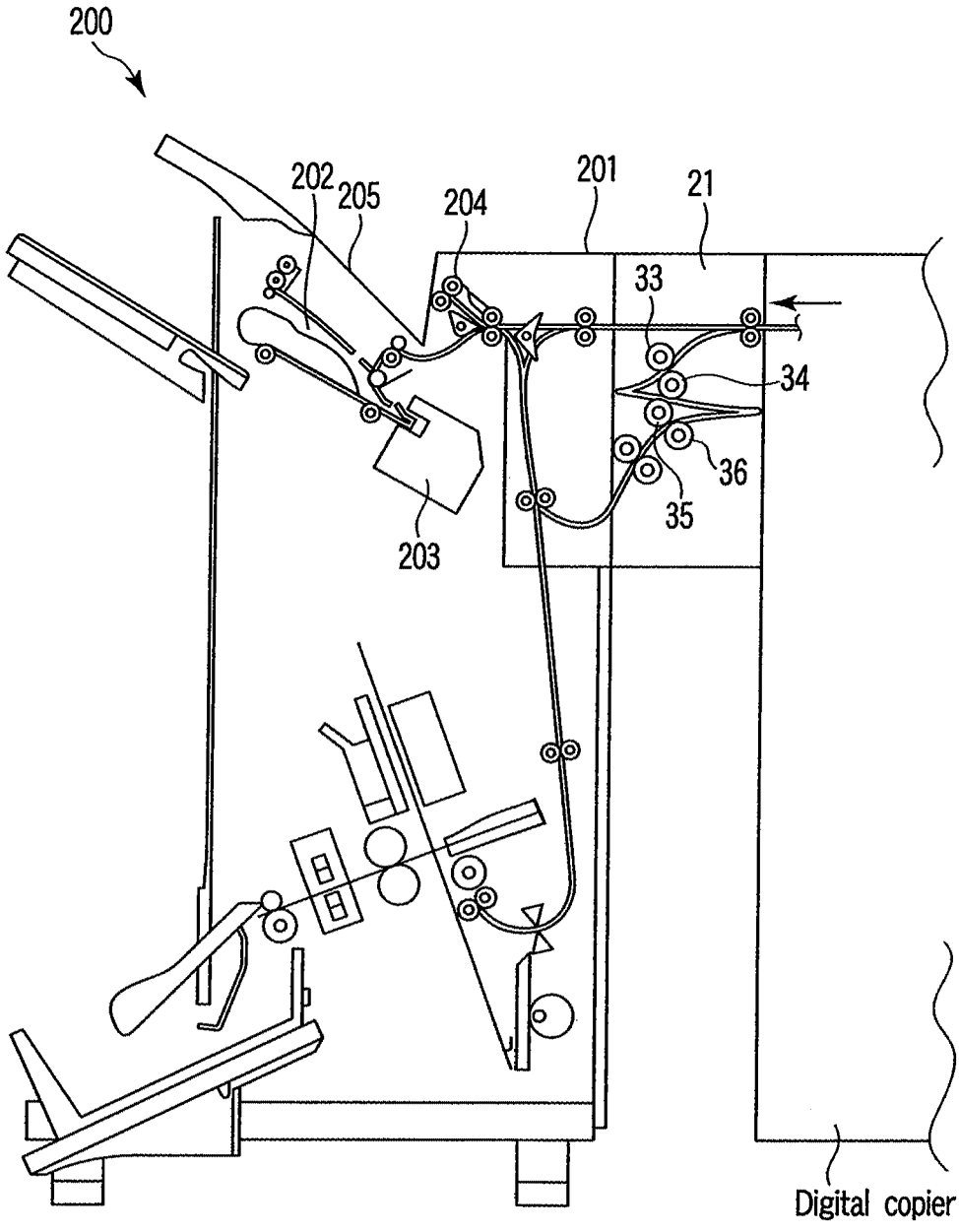
FIG. 16 is a schematic view showing a structure of a Z-folding mechanism of another embodiment of the invention.
Figure 17:
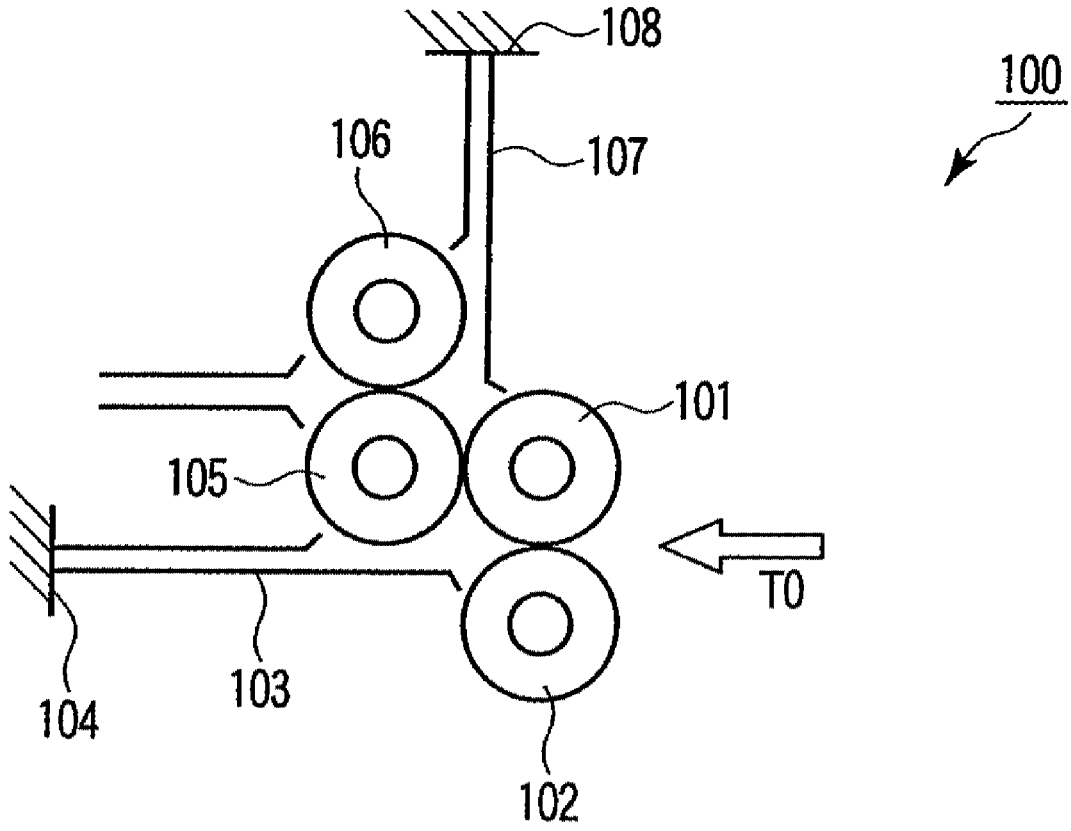
FIG. 17 is a schematic view showing an example of a Z-folding mechanism.

Further, as shown in FIG. 16, the Z-folding mechanism of the invention may be provided between a digital copier and a finisher 200. Here, the Z-folding mechanism 21 is coupled to the finisher 200 through a junction device 201. The finisher 200 is for forming a sheet bundle P' by accumulating sheets P, which have been subjected to a print process by the digital copier and a folding process by the Z-folding mechanism 21, in the unit of the number of copies, by aligning them by an alignment mechanism 202, and by applying a post process such as a stapling process by a sheet stapler 203.

By this, a mixing staple process of sheets of different sheet sizes becomes possible. For example, when the sheet size of the staple process is set to A4 size, after a sheet of A3 size is Z-folded, the sheet is transported to the finisher 200 through the junction device 201 and is stapled. Further, the sheet subjected to the Z-folding process is discharged and is loaded on a paper ejection tray 205 through a transport path 204.

Besides, features included in the plurality of embodiments can be combined or features can be appropriately omitted.

The invention is not limited to the above embodiments. When the invention is carried out, it is needless to say that components of the invention, such as the specific shapes of the respective structural members, can be variously modified in the scope not departing from the gist of the invention and the invention can be carried out.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A Z-folding apparatus comprising:

a pair of feed rollers to transport a sheet along a specified transport passage;

auxiliary mechanisms having a contact portion with which a head of the transported sheet comes in contact, and a press member to press a specified position of the sheet apart from the head; and a pair of folding rollers to form a fold line on the sheet and to transport the sheet on which the fold line has been formed, wherein the press member is coupled to the contact portion so that the press member rotates with the contact portion around a support shaft intersecting with a transport direction of the sheet, and when the head of the sheet comes in contact with the contact portion, the contact portion is pressed by the transported sheet, and the auxiliary mechanisms rotate around the support shaft, and the press member presses the specified position of the sheet apart from the head in a transport direction toward the pair of folding rollers, and guides it to a nip between the rollers of the pair of folding rollers and to press the sheet into the nip of the folding rollers.

2. The Z-folding apparatus according to claim 1, wherein the press member operates in synchronization with the contact portion at a specified timing corresponding to contact of the head of the sheet.

3. The Z-folding apparatus according to claim 1, further comprising an urging part configured to urge the press member in a direction of retracting from the sheet, wherein when the contact portion is pressed by the transported sheet, the contact portion and the press member rotate around the support shaft against an urging force of the urging part, and when the sheet is separated from the contact portion, the press member is retracted from the sheet by the urging force.

4. A sheet processing apparatus comprising:

a pair of feed rollers that nips and rotates a sheet to transport the sheet;

a contact member that is disposed downstream of the pair of feed rollers in a direction of the transport and comes in contact with a head portion of the sheet transported by the pair of feed rollers;

a pair of folding rollers a nip of which is disposed at a main surface side of the transported sheet between the pair of feed rollers and the contact member, and which receives the sheet into the nip and folds it;

a press member that is provided between the pair of feed rollers and the pair of folding rollers, presses a specified part of the sheet apart from the head toward the pair of folding rollers to form a warp on the sheet and guides a portion deformed into a convex shape toward the nip of the pair of folding rollers; and a coupling member that couples the contact member and the press member, and moves, when the contact member is pressed by the transport of the sheet, the press member in a direction of pressing the sheet toward the folding rollers in synchronization with the pressing of the contact member, wherein a plurality of the pairs of feed rollers, a plurality of the pairs of folding rollers, a plurality of the press members, and a plurality of the coupling members are provided along the direction of the transport, and when an angle between a line connecting axial centers of the pair of feed rollers at an upstream side and a line connecting axial centers of a first pair of folding rollers is $\eta 1$, and an angle between a line connecting axial centers of the pair of feed rollers at a downstream side and the line connecting the axial centers of the first pair of folding rollers is $\eta 2$, the respective rollers are disposed to satisfy a relation of $\eta 1 > \eta 2$.

5. The sheet processing apparatus according to claim 4, wherein the press member includes, at a tip, a blade moving to the pair of folding rollers.

6. The sheet processing apparatus according to claim 4, wherein the press member moves toward the pair of folding rollers, and has a curved outer surface at a side of the pair of folding rollers.

7. The sheet processing apparatus according to claim 4, wherein a roller used for the plurality of the pairs of feed rollers or the pairs of folding rollers is common to them.

8. The sheet processing apparatus according to claim 4, wherein a diameter of the roller disposed at an upstream side is smaller than a diameter of the roller disposed at a downstream side.

9. The sheet processing apparatus according to claim 4, wherein a sheet transport path from the feed roller to the contact member becomes narrow from a side of the feed roller to a side of the contact member.

10. The sheet processing apparatus according to claim 9, wherein the sheet transport path from the feed roller to the contact member has a taper shape in which a section of the path vertical to a transport direction becomes small from a vicinity of a downstream side of the feed roller to the contact member.

11. A Z-folding method comprising:

transporting a sheet along a specified transport passage by a pair of feed rollers;

bringing a head of the transported sheet into contact with a contact portion;

forming a fold line on the sheet, the fold line being formed by an auxiliary mechanism which has the contact portion and a press member, the press member being coupled to the contact portion to be rotatable with the contact portion around a support shaft intersecting with a transport direction of the sheet, so that when the contact portion is pressed by the transported sheet, the press member rotates around the support shaft and presses a specified portion of the sheet apart from the head into the nip of folding rollers; and transporting, by the folding rollers, the sheet on which the fold line has been formed.

12. The Z-folding method according to claim 11, wherein the press member is operated in synchronization with the contact portion at a specified timing corresponding to contact of the head of the sheet.

13. The Z-folding method according to claim 11, wherein when the contact portion is pressed by the transported sheet, the contact portion and the press member rotate around the support shaft against an urging force of an urging part configured to urge the press member in a direction of retracting from the sheet, and when the sheet is separated from the contact portion, the press member is retracted from the sheet by the urging force.

* * * * *